US011326350B2

(12) United States Patent
Nash et al.

(10) Patent No.: US 11,326,350 B2
(45) **Date of Patent: *May 10, 2022**

(54) SHORT PENETRATION FLASHING, FLASHING SYSTEMS AND METHODS FOR INSTALLING THEM

(71) Applicant: CertainTeed LLC, Malvern, PA (US)

(72) Inventors: Alex C. Nash, Downingtown, PA (US); Stephen Koch, Collegeville, PA (US); Robert L. Jenkins, Honeybrook, PA (US); Christopher C. Fisher, Philadelphia, PA (US)

(73) Assignee: CertainTeed LLC, Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/068,400

(22) Filed: Oct. 12, 2020

(65) Prior Publication Data

US 2021/0025170 A1 Jan. 28, 2021

Related U.S. Application Data

(63) Continuation of application No. 16/233,708, filed on Dec. 27, 2018, now Pat. No. 10,801,209.

(60) Provisional application No. 62/615,380, filed on Jan. 9, 2018.

(51) Int. Cl.
*E04D 13/147* (2006.01)
*E04D 3/38* (2006.01)

(52) U.S. Cl.
CPC ..... *E04D 13/147* (2013.01); *E04D 3/38* (2013.01)

(58) Field of Classification Search
CPC ..... E04D 13/147; E04D 3/38
See application file for complete search history.

(56) References Cited

U.S. PATENT DOCUMENTS 4,428,361 A * 1/1984 Straza ..... E04D 1/2949 126/668
4,442,643 A * 4/1984 Stadheim ..... E04F 17/04 285/44
4,784,383 A * 11/1988 Roberts ..... A47D 13/105 472/125
5,946,877 A * 9/1999 Gallinat ..... E04D 1/20 52/543
7,762,027 B1 * 7/2010 Wentworth ..... F24S 25/61 52/173.3
7,921,607 B2 * 4/2011 Thompson ..... H02S 20/23 52/60
8,122,648 B1 * 2/2012 Liu ..... F24S 25/613 52/58

(Continued)

*Primary Examiner* — Beth A Stephan
(74) *Attorney, Agent, or Firm* — McDonnell Boehnen Hulbert & Berghoff LLP

(57) ABSTRACT

The present disclosure relates generally to a roofing system including flashing, for example, suitable for protecting a roof from water leakage. The present disclosure relates more particularly to a roofing system including first, second, and third courses of shingles, where the second course overlaps the first and the third course overlaps the second. A flashing plate is disposed over the first course of shingles and partially under the second course of shingles. The flashing plate and the third course of shingles are spaced apart by a gap in a direction of the slope of the roof between a top edge of the flashing plate and a lower edge of the third course of shingles.

23 Claims, 8 Drawing Sheets

(56) References Cited

U.S. PATENT DOCUMENTS

| | | | | |
|---|---|---|---|---|
| 8,146,299 | B2 * | 4/2012 | Stearns | E04D 13/10 52/58 |
| 8,516,765 | B2 * | 8/2013 | Shaw | B32B 27/20 52/553 |
| 8,713,858 | B1 * | 5/2014 | Xie | F24S 25/613 52/58 |
| 8,756,881 | B2 * | 6/2014 | West | F24S 25/33 52/173.3 |
| 9,080,792 | B2 * | 7/2015 | Patton | F24S 25/61 |
| 9,765,513 | B2 * | 9/2017 | Stucky | E04F 19/024 |
| 10,551,090 | B2 * | 2/2020 | De Vogel | F24S 25/613 |
| 10,801,209 | B2 * | 10/2020 | Nash | E04D 13/147 |
| 2001/0037617 | A1 * | 11/2001 | Chi | E04F 19/028 52/288.1 |
| 2006/0130419 | A1 * | 6/2006 | Bowman | E04D 1/265 52/560 |
| 2010/0307074 | A1 * | 12/2010 | Stearns | H02S 20/23 52/173.1 |
| 2011/0197534 | A1 * | 8/2011 | Belt | B32B 5/26 52/520 |
| 2015/0167313 | A1 * | 6/2015 | Steffes | E04C 2/38 52/506.01 |
| 2017/0175393 | A1 * | 6/2017 | Leitch | E04D 1/26 |
| 2018/0097470 | A1 * | 4/2018 | Truthseeker | E04D 13/1473 |
| 2018/0340336 | A1 * | 11/2018 | Fischer | E04D 13/14 |

* cited by examiner

SHORT PENETRATION FLASHING, FLASHING SYSTEMS AND METHODS FOR INSTALLING THEM

CROSS-REFERENCE TO RELATED APPLICATIONS

This application is a continuation of U.S. patent application Ser. No. 16/233,708, filed Dec. 27, 2018, which claims the benefit of priority of U.S. Provisional Patent Application No. 62/615,380, filed Jan. 9, 2018, each of which is hereby incorporated herein by reference in its entirety.

BACKGROUND OF THE DISCLOSURE

1. Field of the Disclosure

The present disclosure relates generally to a roofing system including flashing, for example, suitable for protecting the roof from water leakage. The present disclosure relates more particularly to a roofing system including shingles and flashing plates that seal roof penetrations through the shingles.

2. Technical Background

There are a variety of different reasons to form penetrations in a roof. In some cases, a penetration in the roof is needed to provide access for a structure passing through the roof surface, such as a data cable for a satellite, or a pipe for a solar water heater. In other cases, a penetration is used when a structure is being mounted on the roof, such as photovoltaic cells and modules. The surface of the roof typically does not provide sufficient support for heavy objects, so the structures being placed on the roof are supported by anchors attached to the rafters of the roof through the penetrations. While penetrations are necessary, they also inherently provide the potential for leaks, as water may flow through the penetration and into the underlying space.

To prevent leaks in a roof, flashing is used around any openings in the roof or at any discontinuities in the shingles, e.g., where two roof sections meet. The flashing provides a water resistant cover around the vulnerable area to prevent water infiltration through the roof, for example by diverting water around the roof penetration. Where a small penetration in the roof is made, a flashing plate can be inserted between shingles to prevent water migration into the penetration. These flashing plates are typically large and extend under multiple layers of shingles to ensure that water cannot migrate under the flashing plate through a gap in the shingles. Moreover, many roof installations, in particular photovoltaic solar cell installations, require a multitude of roof penetrations, each of which is covered by the large conventional flashing plate.

The present inventors have recognized that conventional flashing plates use significantly more material than necessary to provide an effective barrier over the corresponding roof penetration, and that a solution using less material would be more economical and attractive to builders.

SUMMARY OF THE DISCLOSURE

In one aspect, the present disclosure provides a roofing system comprising:

a first course of shingles including an upper end and a lower end, the first course of shingles having a first roof penetration extending therethrough;

a second course of shingles overlapping a portion of the first course of shingles and covering the upper end of the first course of shingles, the second course of shingles including an upper end and a lower end;

a third course of shingles overlapping a portion of the second course of shingles and covering the upper end of the second course of shingles, the third course of shingles including an upper end and a lower end; and a flashing plate including a top edge and a bottom edge, wherein the flashing plate is disposed over the first course of shingles and covers the first roof penetration, wherein the flashing plate is disposed partially under the second course of shingles, and wherein the flashing plate and the third course of shingles are spaced apart by a gap in a direction of the slope of the roof between the top edge of the flashing plate and the lower end of the third course of shingles.

In another aspect, the disclosure provides a method of installing a roofing system, the method comprising:

forming a hole through a first course of shingles to create a first roof penetration;

positioning a flashing plate over the first course of shingles, covering the roof penetration, and at least partially under a second course of shingles, so as to form a roofing system as described herein.

In another aspect, the disclosure provides a flashing plate for use in any of the methods described herein, the flashing plate comprising:

a body comprising:

a front surface, a rear surface, a top edge, a bottom edge, a height between the top edge and the bottom edge that is less than 9 inches, and two side edges.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have recognized that conventional flashing plates use significantly more material than necessary to provide an effective barrier over a penetration. The present inventors have developed a flashing plate that is operative in a majority of situations, but uses significantly less material than conventional flashing plates.

Accordingly, one aspect of the disclosure is a roofing system comprising a first course of shingles including an upper end and a lower end, the first course of shingles having a first roof penetration extending therethrough, a second course of shingles overlapping a portion of the first course of shingles and covering the upper end of the first course of shingles, the second course of shingles including an upper end and a lower end, a third course of shingles overlapping a portion of the second course of shingles and covering the upper end of the second course of shingles, the third course of shingles including an upper end and a lower end, and a flashing plate including a top edge and a bottom edge. The flashing plate is disposed over the first course of shingles and covers the first roof penetration. The flashing plate is also disposed partially under the second course of shingles, and the flashing plate and the third course of shingles are spaced apart by a gap in a direction of the slope of the roof between the top edge of the flashing plate and the lower end of the third course of shingles.

Figure 1:
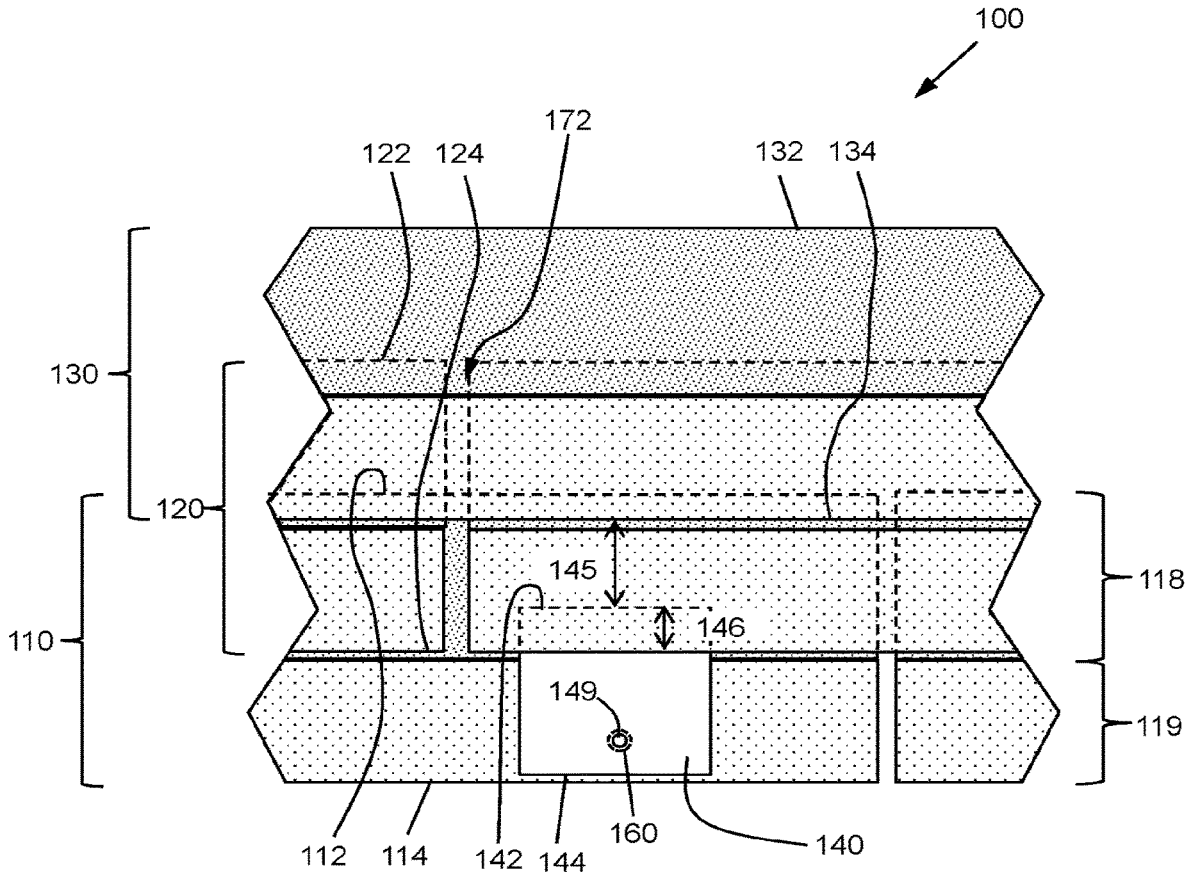
FIG. 1 is a schematic elevation view of a portion of a roof system in accordance with an embodiment of the disclosure.
Figure 2:
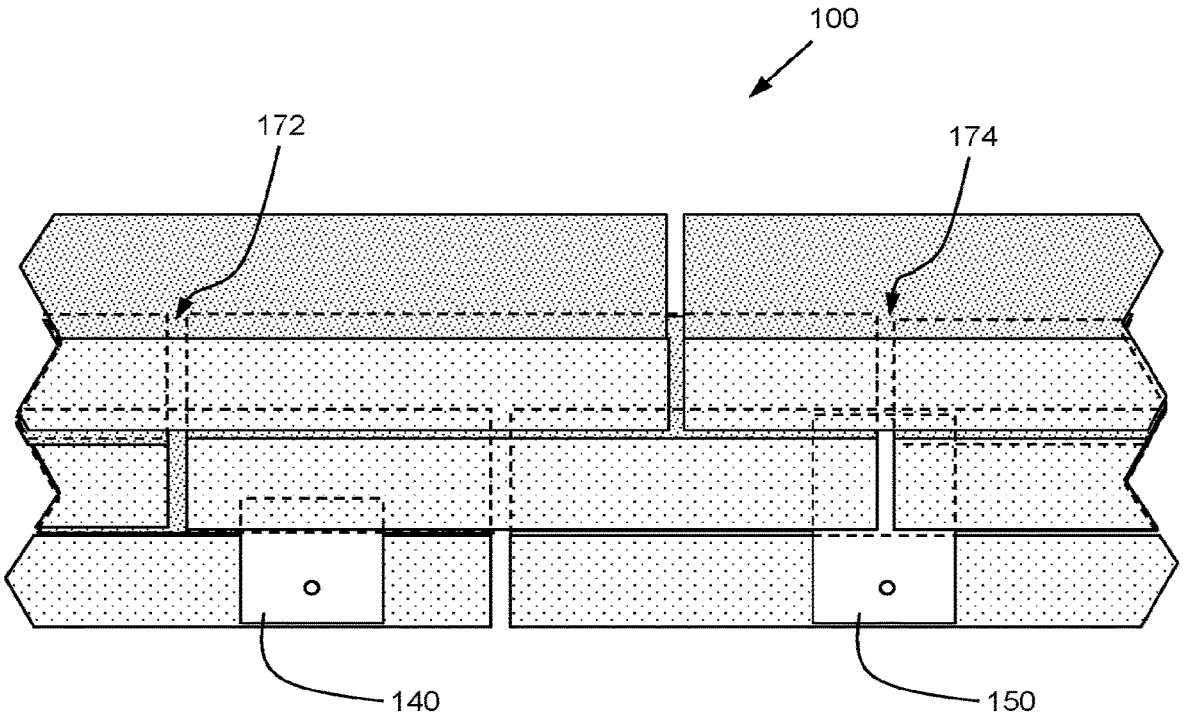
FIG. 2 is a schematic elevation view of an enlarged portion of the roof system of FIG. 1.
Figure 3:
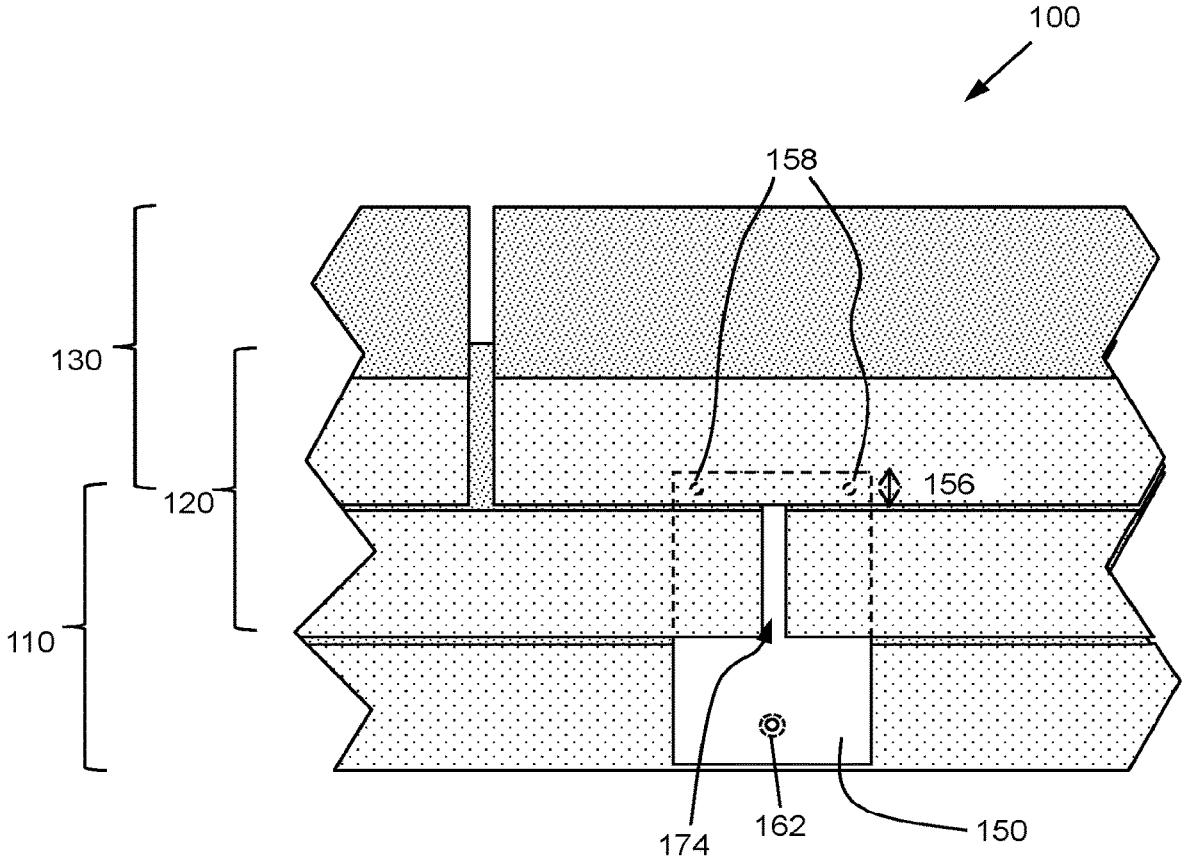
FIG. 3 is a schematic elevation view of another portion of the roof system of FIG. 1.

One embodiment of such a roofing system is shown in FIGS. 1 to 3, which is a top view from a perspective that is perpendicular to the slope of the roof. Accounting for the angle of the roof, the top of the drawings in FIGS. 1 to 3 is up with respect to the direction that is parallel to the slope of the roof, and the foreground is up with respect to the direction that is perpendicular to the slope of the roof. As used herein, the terms upper, lower, top and bottom refer to a direction that is parallel to the slope of the roof, while the terms over and under refer to the direction that is perpendicular to the slope of the roof and coincides with the thickness of the roof. Likewise, as used herein, a first element is described as "covering" the second element if at least a portion of the first element is disposed over the second element with respect to the direction that coincides with the thickness of the roof. Roofing system 100 includes a first course of shingles 110, a second course of shingles 120, and a third course of shingles 130. The first course of shingles 110 is lowest on the roof and has an upper end 112 and a lower end 114. The second course of shingles 120 covers an upper portion of the first course of shingles 110, including upper end 112. The second course of shingles 120 likewise has an upper end 122 and a lower end 124, and the third course of shingles 130 covers the upper end 122 of the second course of shingles 120. The third course also has an upper end 132 and a lower end 134. In each course depicted in FIGS. 1-3, the shingles have an upper portion and lower portion that are shaded differently. The different shaded portions in FIGS. 1-3 substantially align with the lower portions of the shingles that are exposed and the upper portions of the shingles that are overlapped. However, the spacing of the shingles in FIGS. 1-3 is exaggerated so that overlapping areas are more clearly depicted. For further clarity, the upper edges of the shingles that are covered by overlapping courses are shown with dotted lines. The difference in shading is intended only for clarity of the positioning of the shingles, and in many embodiments the surface appearance of the lower portion of the shingles will substantially match the surface appearance of the upper portion of the shingles. However, in other embodiments, the upper portion of the shingles will have a different appearance than the lower portion of the shingles, as in FIGS. 1-3.

Roofing system 100 also includes a flashing plate 140 that is laid over the first course of shingles 110 and under a portion of the second course of shingles 120. The flashing plate 140 covers a first roof penetration 160 that passes through the first course of shingles 110. The flashing plate includes a top edge 142 and a bottom edge 144, and is positioned at a distance from the third course of shingles 130. As a result, a gap 145 is formed in the direction of the slope of the roof between the top edge 142 of the flashing plate 140 and the lower end 134 of the third course of shingles.

The bottom edge 144 of flashing plate 140 is positioned just above the edge at the lower end 112 of the first course of shingles 110 and the top edge 142 is positioned at a measurable distance from the lower end 122 of the second course of shingles 120. Accordingly, an overlap 146 is formed where the second course of shingles 120 covers the top edge 142 of the flashing plate 140. The overlap 146 at the top edge 142 of the flashing plate 140 prevents water from simply running behind the top edge of the flashing plate and to the first penetration 160. Further, the size of the overlap influences the possibility of water migrating up over the top edge 142 of the flashing plate 140 toward the first penetration 160. A larger overlap decreases the likelihood of water migrating over the top edge 142 to the penetration, but also requires a longer flashing plate, and thus, more material. In roof system 100, overlap 146 is about two inches. In certain embodiments, the overlap at the top edge of the flashing is at least ¼ inch, e.g., at least ½ inch, e.g., at least 1 inch, e.g., two inches.

In certain embodiments as otherwise described herein, the flashing plate includes an aperture, and the aperture in the flashing plate is aligned with the first roof penetration. For example, flashing plate 140 includes aperture 149. Further, the flashing plate 140 is positioned so that aperture 149 is directly over first roof penetration 160. Accordingly, aperture 149 provides access through flashing plate 140 to the penetration. The size of penetration 160 in FIG. 1 is exaggerated so that aperture 149 and first penetration 160 are both visible.

In certain embodiments, the roof system further comprises a fastener that extends through the aperture in the flashing plate and into the first roof penetration, and the fastener engages with a support member of the roof. For example, in some embodiments, a metal fastener, such as a bolt or screw extends through the aperture and attaches to a wooden or metal structural member of the roof, such as a roof rafter. As will be appreciated by those of ordinary skill in the art other fasteners may be anchored to the roof. Likewise the fasteners may attach to other members of the roof.

In certain embodiments, the aperture is sealed by an annular elastomeric seal between the fastener and the inside edge of the aperture. In other embodiments, the fastener is built in to the flashing plate. For example, the fastener may be metal and riveted into the aperture in the flashing plate. Other seals between the aperture and the fastener are also possible, as will be appreciated by those of ordinary skill in the art.

Figure 9:
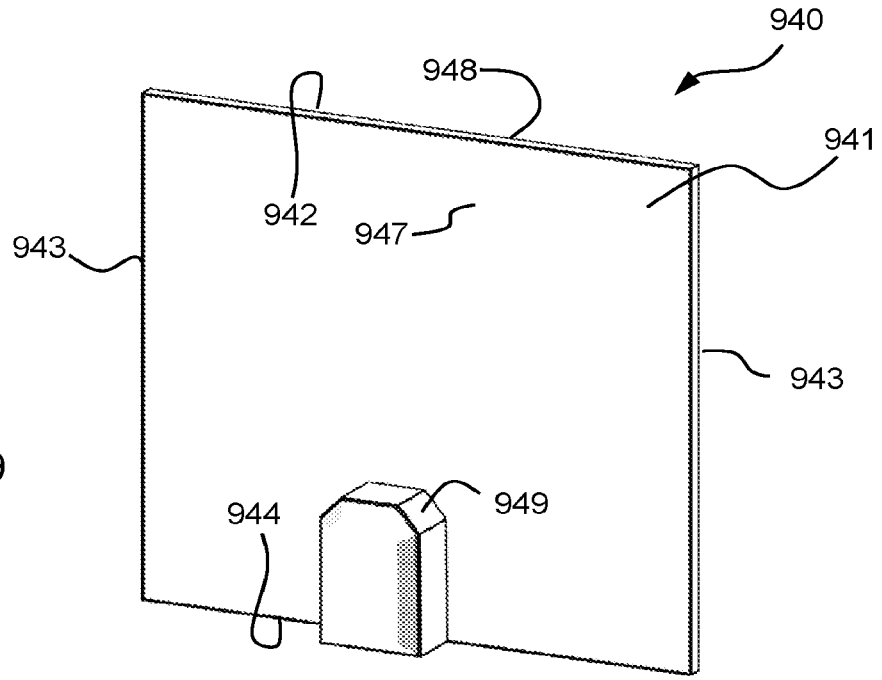
FIG. 9 is a schematic perspective view of a flashing plate in accordance with yet another embodiment of the disclosure.

In certain embodiments, a front surface of the flashing plate includes a projection that forms a recess on the rear surface of the flashing plate. For example, flashing plate 940, shown in FIG. 9 (described in more detail below), includes projection 949. In certain embodiments, the flashing plate including the projection and corresponding recess is positioned so that the recess is aligned with a roof penetration. In some embodiments, the recess is open along one edge of the flashing plate and provides access to the roof penetration.

In certain embodiments, the roof system further includes a bracket disposed in the recess, and a fastener that is attached to the bracket, that extends through the first roof penetration, and that engages a support member of the roof. For example, in some embodiments the bracket is an L-shaped bracket with a first leg that slides under the recess and a second leg that extends up from the roof. The first leg attaches to a fastener that extends through the roof penetration and couples to a support member, such as a rafter. The second leg extends out from the roof surface in order to provide structural support for an installation on the roof, such as a photovoltaic cell. To install the bracket, the fastener and bracket may first be installed on the roof, and the flashing plate laid over the bracket with the first leg disposed inside the recess.

In certain embodiments, the shingles are asphalt shingles, for example fiberglass shingles or organic shingles. In certain embodiments the shingles are architectural shingles and contain a textured surface. In other embodiments, the shingles are tile, while in other embodiments the shingles are wood. Other types of shingles are also possible, as will be appreciated by those of ordinary skill in the art.

In certain embodiments as otherwise described herein, the shingles are rectangular. For example, in FIGS. 1-3 the shingles in the first, second and third courses are all in the shape of rectangles. In other embodiments, the shingles have a more complex shape. In particular, in certain embodiments the lower edge of the shingles has a complex contour. For example, in some embodiments, as described in more detail below, the shingles include one or more tabs that extend down from the rest of the body of the shingle.

Figure 4:
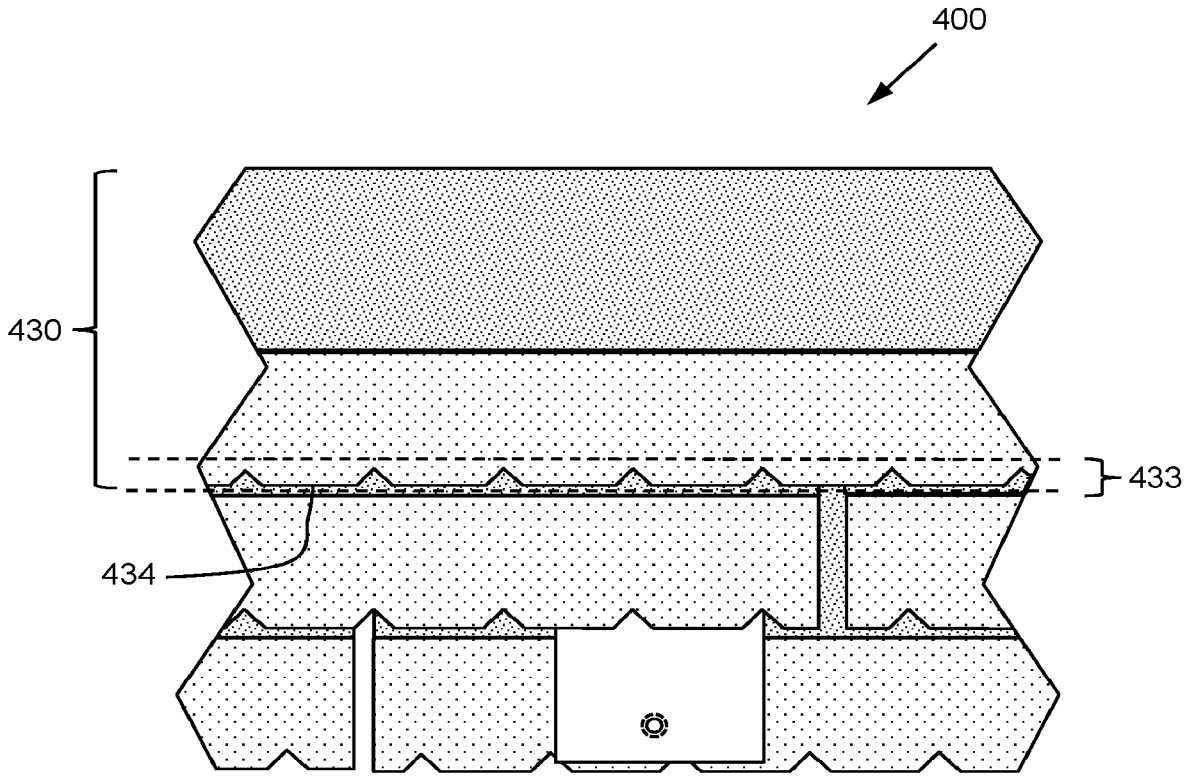
FIG. 4 is a schematic elevation view of a portion of a roof system in accordance with another embodiment of the disclosure.

In certain embodiments as otherwise described herein, the lower end of each course of shingles is straight. For example, the lower edges of the shingles in the courses of roof system 100 are straight, and the corresponding lower ends of the courses are also straight. In other embodiments, the lower end of each course of shingles has a patterned contour. For example, in roof system 400, shown in FIG. 4, the lower edge of each shingle includes a contour having horizontal and angled sections and has the appearance of a series of connected polygons. The lower end of the corresponding course of shingles, accordingly, has the same patterned contour.

In certain embodiments as otherwise described herein, an edge of the patterned contour is contained within a two inch band that extends across the width of the shingles. For example, the contour of the lower end 434 of the third course 430 in roof system 400 runs substantially horizontally across the width of the shingles, but rises and falls in a shallow pattern with the corresponding edge always staying within band 433. The resulting shingles have a variance in height that is no more than two inches across their entire width.

In certain embodiments, the lower end of each course of shingles is formed by respective lower edges of the shingles within the respective course. For example, in roof system 100, the lower edges of the respective shingles form the lower ends 114, 124, 134 of the corresponding course of shingles, 110, 120, 130. In other embodiments, at least one of the shingles includes a tab extending down beyond the lower end of the respective course of shingles. For example, in roof system 500, the shingle in the third course 530 includes a tab 536 that extends below the lower end 534 of the third course 530. Likewise, the rightmost shingle in the second course 520 also includes a tab 526 that extends down below the lower end 524 of second course 520.

In certain embodiments as otherwise described herein, each shingle includes an exposed area and a headlap area that is covered by a respective overlapping course of shingles, and the height of the headlap area is larger than the height of the exposed area. For example, in roof system 100, as depicted with respect to the first course of shingles 110, the headlap area 118 is two inches greater in height than the exposed area 119. This difference in height results in a slight overlap of the top of the headlap area 119 at the upper end 112 of the first course of shingles 110 by the lower end 134 of the third course of shingles 130, in addition to the overlap by the second course of shingles 120.

In certain embodiments as otherwise described herein, the height of the headlap area is in a range between 4 inches and 14 inches, e.g., in a range between 6 and 10 inches, e.g., in a range between 7.25 inches and 7.75 inches, e.g., 7⅝ inches. Likewise, in certain embodiments, the height of the exposed area is in a range between 4 and 12 inches, e.g., 5, inches, 6 inches, 7 inches, 7.5 inches, 8 inches or 10 inches. In certain embodiments the height of the exposed area is in a range between 5¼ inches and 5¾ inches, e.g., 5⅝ inches.

In certain embodiments as otherwise described herein, a width of each shingle is in a range between 24 and 48 inches, e.g., in a range between 30 and 42 inches, e.g., in a range between 36 and 40 inches, e.g., 38¾ inches. In some embodiments, this width is substantially larger than the width of the flashing plate, yielding the potential for significant reduction in flashing material, as explained in more detail below.

In certain embodiments as otherwise described herein, the second course of shingles includes a pair of adjacent shingles forming a butt joint. For example, in roof system 100 there is a butt joint 172 between adjacent shingles in the second course 120 to the left of flashing plate 140. In the expanded view of roof system 100 shown in FIG. 2, a second butt joint 174 can also be seen in second course 120. The first and third courses also include butt joints toward the center of the depiction shown in FIG. 2.

In certain embodiments as otherwise described herein, the first penetration in the first course of shingles is offset laterally from the butt joint in the second course of shingles by at least 2 inches, e.g., at least 3 inches, e.g., at least 4 inches, e.g. at least 6 inches. For example, penetration 160 in first course 110 is approximately 6 inches to laterally offset to the right of butt joint 172 in second course 120.

In certain embodiments as otherwise described herein, the first course of shingles includes a second penetration that is in a vicinity of a butt joint in the second course of shingles. In certain embodiments, the second penetration in the first course is laterally offset from the butt joint in the second course by no more than 6 inches, e.g., no more than 4 inches, e.g., no more than 3 inches, e.g. no more than 2 inches. For example, in roof system 100, a second roof penetration 162 is positioned immediately below butt joint 174 with very little lateral offset.

In certain embodiments as otherwise described herein, the roof system further includes an elongate flashing plate including a top edge and a bottom edge, wherein the elongate flashing plate is disposed over the first course of shingles, covering the second penetration, and under the butt joint in the second course of shingles. A portion of the lower end of the third course of shingles covers the top edge of elongate flashing so as to form an overlap between the top edge of the elongate flashing and the lower end of the third course of shingles. For example, in roof system 100, as shown in the detailed view of FIG. 3, elongate flashing plate 145 is disposed over first course of shingles 110 and under second course of shingles 120. Further, the elongate flashing plate 150 is disposed so as to cover the second roof penetration 162 and is positioned underneath butt joint 174. Elongate flashing plate 150 is significantly taller than flashing plate 140 and extends up second course 120 and into third course 130. As a result, the lower end 134 of third course 130 overlaps with the top edge 152 of elongate flashing plate. The overlap protects water from passing through the gap formed by the butt joint, behind the flashing plate, and into the roof penetration 162.

In certain embodiments as otherwise described herein, the roof system includes a second flashing plate including a top edge and a bottom edge, wherein the second flashing plate is disposed over the first course of shingles, covering the second roof penetration, and under the butt joint in the second course of shingles. Further, a cover is disposed over the top edge of the second clashing plate. For example, in roof system 600, flashing plate 655 is disposed over first course of shingles 610 and under second course of shingles 620. Further, the flashing plate 655 is disposed so as to cover the second roof penetration 662 and is positioned underneath butt joint 674. Unlike elongate flashing plate 145 of roof system 100, flashing plate 655 does not extend up to third course 630. Accordingly, butt joint 674 presents a vulnerability to water leaking behind flashing plate 655 and into the second roof penetration 662. To prevent such leakage, roof system 600 includes a cover 657 over the top edge of the flashing plate 655. In certain embodiments, the cover comprises another flashing plate, mastic or tape. In other embodiments alternative covers are used to seal the butt joint, as will be appreciated by those of ordinary skill in the art.

In certain embodiments, the cover is disposed over the second course of shingles and corresponding butt joint, but under the lower end of the third course of shingles. For example, cover 657 is positioned over the top edge of flashing plate 655 and also over the butt joint in the second course 620, but under the lower end of the third course of shingles 630. This configuration prevents water that is flowing down the slope of the roof from entering the butt joint. In other embodiments, the cover is disposed over the top edge of the flashing plate, but under the second and third courses of shingles. Such a configuration prevents any water that flows into the butt joint in the second course from flowing behind the flashing plate, and operates similarly to the elongate flashing plate described above.

In certain embodiments as otherwise described herein, the first roof penetration is one of an array of roof penetrations. For example, in certain embodiments the roof system includes a plurality of rows and columns of roof penetrations. In certain embodiments, the array of roof penetrations accommodate anchors configured to support a structure on the roof. For example, in certain embodiments, the array includes a row of roof penetrations though the first course of shingles and another row of penetrations through another course of shingles in the roof. Further, in some embodiments the supported structure is an installation of photovoltaic cells.

Another aspect of the present disclosure is a method of installing a roofing system including forming a hole through a first course of shingles to create a first roof penetration, positioning a flashing plate over the first course of shingles, covering the roof penetration, and at least partially under a second course of shingles, so as to form the a roofing system as described in any of the above embodiments. For example, in roof system 100, a hole is formed in the first course of shingles 110 to create first roof penetration 160. The hole may be formed according to a variety of methods as will be appreciated by those of ordinary skill in the art, such as drilling the hole. Flashing plate 140 is then placed over the first course of shingles 110 and covering the first roof penetration 160. Further the flashing plate is also positioned at least partially under the second course of shingles 120.

In certain embodiments as otherwise described herein, the flashing plate includes an aperture, and positioning the flashing plate includes aligning the aperture of the flashing plate with the first roof penetration. For example, when flashing plate 140 is disposed between the first and second courses of shingles 110, 120, the aperture 149 of the flashing is positioned to be coextensive with first roof penetration 160.

In certain embodiments as otherwise described herein, the method includes engaging a support member of the roof using a fastener that extends through the aperture in the flashing plate. For example, in certain embodiments a threaded fastener, such as a bolt is secured to a rafter of the roof.

In certain embodiments as otherwise described herein, the flashing plate includes a recess, and positioning the flashing plate includes positioning the recess of the flashing plate over the first roof penetration. For example, the flashing plate 940 in FIG. 9 includes a projection 949 on the front surface that forms a corresponding recess on the rear surface. When the flashing plate 940 is placed among the shingles of a roof, the recess is positioned over the corresponding roof penetration.

In certain embodiments as otherwise described herein, the method includes positioning a bracket in the recess, and coupling the bracket to a support member of the roof using a fastener that extends through the first roof penetration. For example, in some embodiments the bracket is an L-shaped bracket with a first leg that is coupled to a rafter using a fastener that passes through the roof penetration. The flashing plate is then placed over the penetration with the first leg disposed inside the recess and a second leg of the bracket extending out from the roof surface. The second leg can then provide structural support for an installation on the roof, such as a photovoltaic cell.

Figure 5:
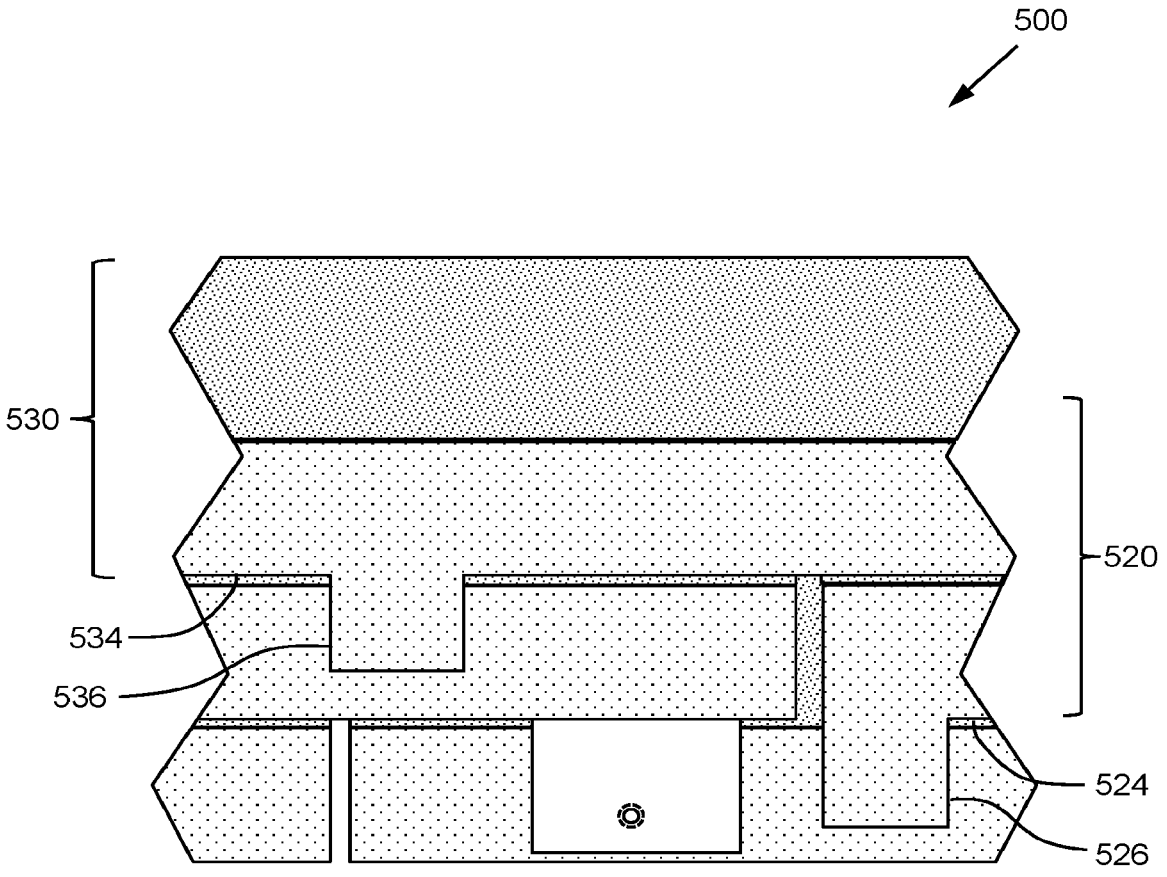
FIG. 5 is a schematic elevation view of a portion of a roof system in accordance with another embodiment of the disclosure.
Figure 6:
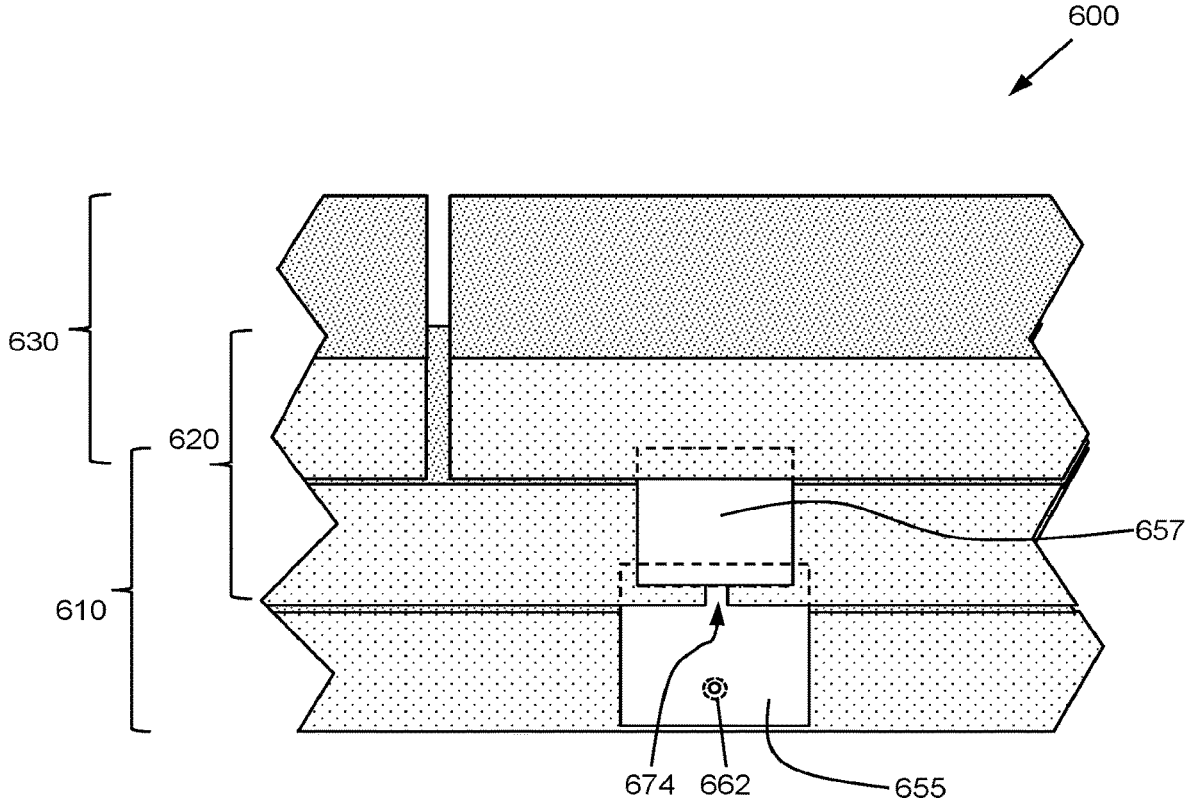
FIG. 6 is a schematic elevation view of a portion of a roof system in accordance with yet another embodiment of the disclosure.

In certain embodiments as otherwise described herein, a shingle in the second course of shingles includes a tab extending down from the respective lower end of the shingle, and the method further comprises removing the tab. For example, in roof system 500, shown in FIG. 5, the shingles include tabs 526 and 536 that extend down from the lower end 524, 534 of the respective course 520, 530. In certain embodiments the tabs are near the roof penetration or cover the roof penetration. To avoid interference by the tabs, in certain embodiments they are removed during installation of the flashing plate.

In certain embodiments as otherwise described herein, the second course of shingles includes a butt joint between two adjacent shingles, and the method further comprises forming a second roof penetration in the first course of shingles in a vicinity of the butt joint. For example, as explained above, in certain embodiments, the second penetration is laterally offset from the butt joint by no more than 6 inches, e.g., no more than 4 inches, e.g., no more than 3 inches, e.g. no more than 2 inches. For example, in roof system 100, second roof penetration 162 is formed directly below butt joint 174.

In certain embodiments as otherwise described herein, the method includes positioning an elongate flashing plate over the first course of shingles, under the butt joint in the second course of shingles, and covering the second roof penetration, such that a portion of a lower end of the third course of shingles covers a top edge of the elongate flashing and forms an overlap between the top edge of the elongate flashing and the lower end of the third course of shingles. For example, in roof system 100, elongate flashing 150 is positioned under butt joint 174. To slide elongate flashing 150 so as to be overlapped by the third course, nails are removed before the elongate flashing is moved into its final position. Once in place, the third course of shingles 130 forms an overlap 156 with the elongate flashing 150.

In certain embodiments as otherwise described herein, the method includes positioning a second flashing plate over the first course of shingles, under a portion of the butt joint in the second course of shingles, and covering the second roof penetration. The method also includes covering a top edge of the second flashing plate. In certain embodiments, covering the top edge of the second flashing plate includes placing another flashing plate, mastic, or tape over the top edge. As will be appreciated by those of ordinary skill in the art, other materials and structures can be used to cover the second flashing plate.

In certain embodiments as otherwise described herein, the method includes forming additional roof penetrations so as to provide an array of roof penetrations. In certain embodiments, the method includes attaching anchors to a structure of the roof through respective roof penetrations. For example, in some embodiments, the anchors are attached to rafters of the roof. Further, in certain embodiments as otherwise described herein, the anchors are coupled to the roof in order to hold a component on the roof, such as a photovoltaic cell in an installation of photovoltaic cells.

Figure 7:
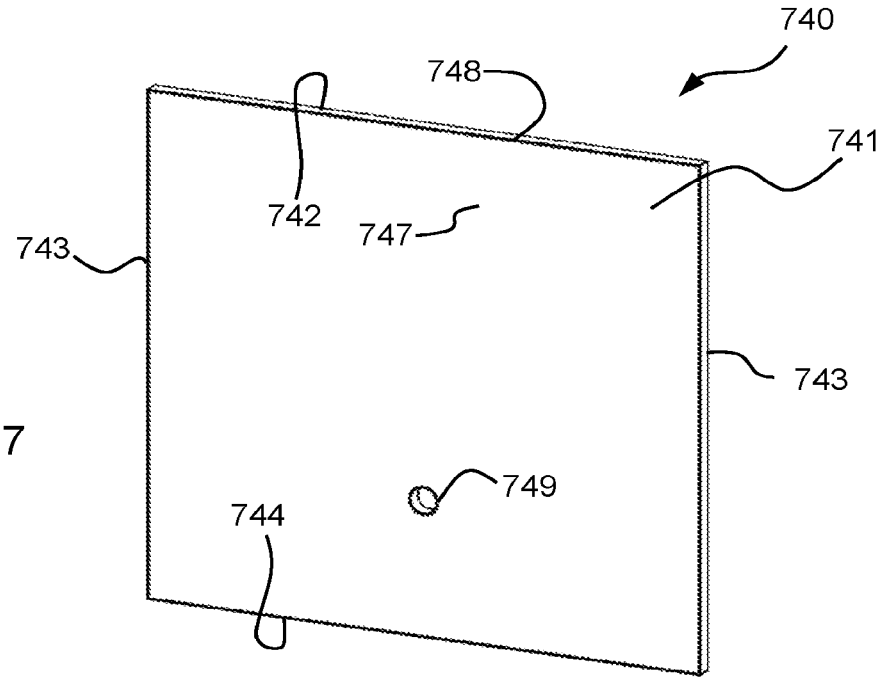
FIG. 7 is a schematic perspective view of a flashing plate in accordance with an embodiment of the disclosure.

Another aspect of the present disclosure is a flashing plate for use in any of the methods described above. The flashing plate comprises a body including a front surface, a rear surface, a top edge, a bottom edge, a height between the top edge and the bottom edge that is less than 9 inches, and two side edges. For example, flashing plate 740 shown in FIG. 7 includes rectangular body 741 that is bordered by top edge 742, side edges 743 and bottom edge 744. The plate is substantially planar and includes a front surface 747 and a rear surface 748. The height of the flashing plate 740 between the top edge 742 and bottom edge 744 is 7⅝ inches. In certain embodiments, the height is in a range between 5 and 14 inches, e.g., 7 inches, 8 inches, 9 inches, 9.5 inches, 10 inches or 12 inches. In certain embodiments the height is in a range between 6 inches and 8 inches, e.g., in a range between 7.25 inches and 7.75 inches, e.g., 7⅝ inches.

In certain embodiments as otherwise described herein, a width of the body is in a range between 4 and 12 inches, e.g., in a range between 6 and 9 inches, e.g., 8 inches. With a width of the flashing plate at 8 inches and the width of the shingles at about 34 inches, the shorter flashing plate can be used over a large majority of each course of shingles. Compared to a flashing plate with a height of 12 inches, a height of only 7⅝ will save 36% of material. As a result, in an installation with a large number of roof penetrations, the shorter flashing can yield a substantial amount of material savings.

In certain embodiments as otherwise described herein, the flashing plate includes an aperture passing through the body from the front surface to the rear surface. In certain embodiments the aperture is in a range between 1 and 3 inches from the bottom edge of the body. For example, flashing plate 740 includes an aperture 749 that is 2 inches from the bottom edge 744 of the body 741 of the flashing plate.

Figure 8:
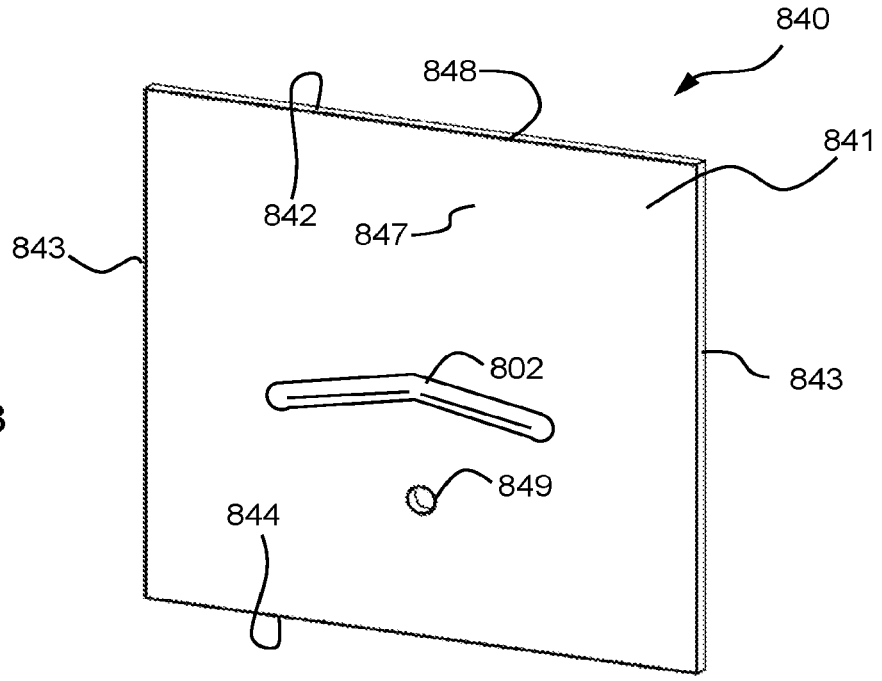
FIG. 8 is a schematic perspective view of a flashing plate in accordance with another embodiment of the disclosure.

In certain embodiments as otherwise described herein, the front surface includes an elongate protrusion extending laterally across the body, and the elongate protrusion is between the aperture and the top edge of the body. For example, flashing plate 840 in FIG. 8 includes elongate protrusion 802 that extends across the central portion of the flashing plate. The protrusion is a ridge that protrudes from the front surface 847 of the flashing plate and is positioned above the aperture 849. The protrusion 802 operates to guide water running down the roof around the aperture.

Figure 10:
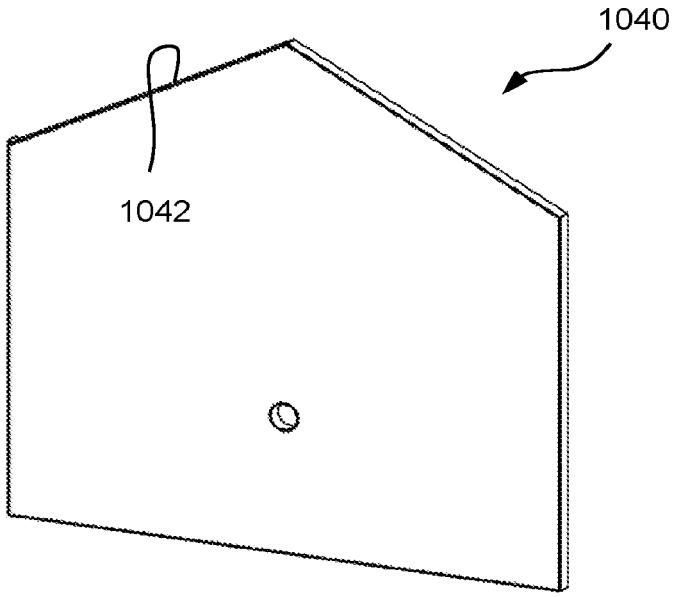
FIG. 10 is a schematic perspective view of a flashing plate in accordance with another embodiment of the disclosure.

In certain embodiments as otherwise described herein, the body of the flashing plate is rectangular. For example, flashing plate 740 in FIG. 7 has a rectangular body with straight edges, including a straight top edge 742. In other embodiments the body of the flashing plate has another shape. For example, in some embodiments the body of the flashing plate is in the form of an irregular polygon, or has rounded corners. In certain embodiments, the body of the flashing plate has a top edge that is pointed. For example, flashing plate 1040 in FIG. 10 has a top edge 1042 that comes to a point in the center of the flashing plate. The pointed top edge promotes the use of the flashing plate to separate the shingles as the flashing plate is inserted therebetween.

In certain embodiments the flashing plate has a sharpened edge. For example, in certain embodiments the top edge of the flashing plate is sharpened to a point. This sharpened edge allows the flashing plate to be used to separate the shingles as the flashing plate is inserted therebetween. In addition, the sharpened edge can be used to slide under nails to remove the nails during installation of the flashing plate.

In certain embodiments as otherwise described herein, the flashing plate includes a projection on the front surface of the body that forms a recess facing the rear surface of the body.

In certain embodiments, the projection is disposed at the bottom edge of the body. For example, flashing plate 900 in FIG. 9 includes a projection 949 that extends outward from front surface 947. Opposite the projection 949 is a recess formed by the curvature of the wall of flashing plate 940. The recess is configured to receive elements that pass through or cooperate with the roof penetration.

In certain embodiments as otherwise described herein, the body comprises aluminum. As will be appreciated by those of ordinary skill in the art, the body of the flashing plate may also comprise other materials, for example, an impregnated fiberglass mat.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A method of protecting roof penetrations from water infiltration, the method comprising:

positioning a first flashing plate on a roof over a first course of shingles and partially under a second course of shingles, wherein the first course of shingles has first and second roofing penetrations extending therethrough, wherein the second course of shingles overlaps a portion of the first course of shingles and covers an upper end of the first course of shingles, wherein a third course of shingles overlaps a portion of the second course of shingles and covers an upper end of the second course of shingles, wherein the first flashing plate is positioned to cover the first roofing penetration, to be partially disposed under the second course of shingles, and to be spaced from the third course of shingles so as to form a gap in a direction of the slope of the roof between a top edge of the flashing plate and a lower end of the third course of shingles; and positioning an elongate second flashing plate on the roof over the first course of shingles and partially under the second course of shingles, the elongate second flashing plate being longer than the first flashing plate, wherein the elongate second flashing plate is positioned to cover the second roofing penetration, to be partially disposed under the second course of shingles, and to extend under the third course of shingles so as to form an overlap between a top edge of the elongate second flashing plate and the lower end of the third course of shingles.

2. The method according to claim 1, wherein the elongate second flashing plate is disposed in a vicinity of a discontinuity in the second course of shingles.

3. The method according to claim 2, wherein the discontinuity in the second course of shingles is a butt joint between two shingles.

4. The method according to claim 1, wherein the first flashing plate has a height between the top edge of the first flashing plate and a bottom edge of the first flashing plate that is less than 9 inches.

5. The method according to claim 1, wherein the first flashing plate includes an aperture, and wherein positioning the first flashing plate includes aligning the aperture with the first roof penetration, the method further comprising inserting a fastener through the aperture and into the first roof penetration and engaging the fastener with a support member of the roof.

6. The method according to claim 1, wherein a front surface of the first flashing plate includes a projection that forms a recess on a rear surface of the first flashing plate, wherein a bracket is secured to the roof by a fastener that extends through the first roof penetration, and wherein positioning the first flashing plate includes inserting the bracket into the recess provided on the rear surface of the first flashing plate.

7. A kit for protecting roof penetrations from water intrusions, the kit comprising:

a plurality of first flashing plates, each of the first flashing plates being configured to be positioned on a roof over a first course of shingles so as to cover a respective roofing penetration in the first course of shingles and partially under a second course of shingles, such that each first flashing plate is spaced from a third course of shingles that overlaps a portion of the second course of shingles, such that a gap is formed in a direction of the slope of the roof between a top edge of the respective first flashing plate and a lower end of the third course of shingles; and an elongate second flashing plate that is longer than each of the first flashing plates, the elongate second flashing plate being configured to be positioned on the roof to cover the second roofing penetration, to be partially disposed under the second course of shingles, and to extend under the third course of shingles so as to form an overlap between a top edge of the elongate second flashing plate and the lower end of the third course of shingles.

8. The kit according to claim 7, wherein each of the first flashing plates has a height between the top edge and bottom edge that is less than 9 inches.

9. The kit according to claim 7, wherein each of the flashing plates includes an aperture extending form a front surface of the respective flashing plate to a rear surface, the aperture being configured to receive a fastener that extends through a respective roofing penetration.

10. The kit according to claim 7, wherein a front surface of each flashing plate includes a projection that forms a recess on a rear surface of the respective flashing plate, the recess being configured to receive a bracket that supports a structure on the roof.

11. The kit according to claim 7, further comprising a plurality of asphalt or architectural shingles configured to form the first, second and third courses of shingles.

12. A method of protecting roof penetrations from water intrusion, the method comprising:

positioning a first flashing plate on a roof over a first course of shingles and partially under a second course of shingles, wherein the first course of shingles has first and second roofing penetrations extending therethrough, wherein the second course of shingles overlaps a portion of the first course of shingles and covers an upper end of the first course of shingles, wherein a third course of shingles overlaps a portion of the second course of shingles and covers an upper end of the second course of shingles, wherein the first flashing plate is positioned to cover the first roofing penetration, to be partially disposed under the second course of shingles, and to be spaced from the third course of shingles so as to form a gap in a direction of the slope of the roof between a top edge of the flashing plate and a lower end of the third course of shingles;

positioning a second flashing plate on the roof over the first course of shingles and partially under the second course of shingles, wherein the second flashing plate is positioned to cover the second roofing penetration, and to be partially disposed under the second course of shingles and in a vicinity of a discontinuity in the second course of shingles; and positioning a cover over a top edge of the second flashing plate so as to deter water infiltration through the discontinuity in the second course of shingles.

13. The method according to claim 12, wherein the cover includes at least one of an additional flashing plate, mastic, or tape.

14. The method according to claim 12, wherein the discontinuity in the second course of shingles is a butt joint between two shingles.

15. The method according to claim 12, wherein the first flashing plate has a height between the top edge of the first flashing plate and a bottom edge of the first flashing plate that is less than 9 inches.

16. The method according to claim 12, wherein the first flashing plate includes an aperture, and wherein positioning the first flashing plate includes aligning the aperture with the first roof penetration, the method further comprising inserting a fastener through the aperture and into the first roof penetration and engaging the fastener with a support member of the roof.

17. The method according to claim 12, wherein a front surface of the first flashing plate includes a projection that forms a recess on a rear surface of the first flashing plate, wherein a bracket is secured to the roof by a fastener that extends through the first roof penetration, and wherein positioning the first flashing plate includes inserting the bracket into the recess provided on the rear surface of the first flashing plate.

18. A kit for protecting roof penetrations from water intrusions, the kit comprising:

a plurality of flashing plates, each of the flashing plates being configured to be positioned on a roof over a first course of shingles so as to cover a respective roofing penetration in the first course of shingles and partially under a second course of shingles, such that each first flashing plate is spaced from a third course of shingles that overlaps a portion of the second course of shingles, such that a gap is formed in a direction of the slope of the roof between a top edge of the flashing plate and a lower end of the third course of shingles; and a cover configured to cover a top edge of a respective one of the flashing plates so as to deter water infiltration through a discontinuity in the second course of shingles.

19. The kit according to claim 18, wherein the cover includes at least one of an additional flashing plate, mastic, or tape.

20. The kit according to claim 18, wherein each of the first flashing plates has a height between the top edge and bottom edge that is less than 9 inches.

21. The kit according to claim 18, wherein each of the flashing plates includes an aperture extending form a front surface of the respective flashing plate to a rear surface, the aperture being configured to receive a fastener that extends through a respective roofing penetration.

22. The kit according to claim 18, wherein a front surface of each flashing plate includes a projection that forms a recess on a rear surface of the respective flashing plate, the recess being configured to receive a bracket that supports a structure on the roof.

23. The kit according to claim 18, further comprising a plurality of asphalt or architectural shingles configured to form the first, second and third courses of shingles.

* * * * *